US007028470B1

(12) United States Patent
Achten

(10) Patent No.: US 7,028,470 B1
(45) Date of Patent: Apr. 18, 2006

(54) APPARATUS FOR EXECUTING ACTIVITIES ASSISTED BY HYDROMOTORS AND A HYDRAULIC TRANSFORMER FOR USE IN SUCH AN APPARATUS

(75) Inventor: Peter Augustinius Johannes Achten, Eindhoven (NL)

(73) Assignee: Innas Free Piston B.V., Breda (NL)

( * ) Notice: Subject to any disclaimer, the term of this patent is extended or adjusted under 35 U.S.C. 154(b) by 0 days.

(21) Appl. No.: 09/601,961

(22) PCT Filed: Feb. 10, 1999

(86) PCT No.: PCT/NL99/00067

§ 371 (c)(1),
(2), (4) Date: Aug. 9, 2000

(87) PCT Pub. No.: WO99/40318

PCT Pub. Date: Aug. 12, 1999

(30) Foreign Application Priority Data

Feb. 10, 1998 (NL) ..... 1008256
Feb. 13, 1998 (EP) ..... 98200454

(51) Int. Cl.
*F16D 31/02* (2006.01)

(52) U.S. Cl. ..... 60/419

(58) Field of Classification Search ..... 60/419; 417/225, 271, 348
See application file for complete search history.

(56) References Cited

U.S. PATENT DOCUMENTS

| | | | | | |
|---|---|---|---|---|---|
| 2,550,405 | A | * | 4/1951 | Crosby | 60/451 |
| 2,933,897 | A | * | 4/1960 | Toutant | 60/419 |
| 3,039,266 | A | * | 6/1962 | Schenkelberger | 60/419 |
| 3,188,963 | A | * | 6/1965 | Tyler | 60/419 |
| 3,627,451 | A | | 12/1971 | Kouns | |
| 4,187,681 | A | * | 2/1980 | Johnson | 60/403 |
| 4,458,581 | A | | 7/1984 | Paley et al. | |
| 5,251,442 | A | * | 10/1993 | Roche | 60/419 |
| 6,116,138 | A | * | 9/2000 | Achten | 60/419 |

FOREIGN PATENT DOCUMENTS

| | | |
|---|---|---|
| FR | 1 260 078 A | 8/1961 |
| WO | WO 97 31185 A | 8/1997 |

* cited by examiner

*Primary Examiner*—F. Daniel Lopez
(74) *Attorney, Agent, or Firm*—Darby & Darby

(57) ABSTRACT

The invention relates to an apparatus for executing activities assisted by equipment driven by means of rotating or linear hydromotors. The hydromotors may be loaded and/or moved in two directions. The hydromotors are coupled via a connecting line and a hydraulic transformer with a high-pressure line. The hydraulic transformer is provided with adjusting means for controlling the hydromotor and control means are provided for restricting the fluid flow in the hydraulic transformer.

24 Claims, 6 Drawing Sheets

APPARATUS FOR EXECUTING ACTIVITIES ASSISTED BY HYDROMOTORS AND A HYDRAULIC TRANSFORMER FOR USE IN SUCH AN APPARATUS

CROSS-REFERENCE TO PRIOR APPLICATION

This is a U.S. National Phase application under 35 U.S.C. § 371 of International Patent Application No. PCT/NL99/00067, filed Feb. 10, 1999, and claims the benefit of Netherlands Patent Application No. 1008256, filed Feb. 10, 1998 and European Patent Application No. 98200454.1, filed Feb. 13, 1998, all of which are incorporated by reference herein. The International Application was published in English on Aug. 12, 1999 as WO 1999/40318 under PCT Article 21(2).

FIELD OF THE INVENTION

The invention relates to an apparatus for executing activities assisted by equipment driven by means of rotating or linear hydromotors, which may be loaded or moved in two directions. A disadvantage of the known apparatus is that with load variations on the hydromotor, the speed of the hydromotor varies also. Load reduction may create dangerous situations due to the sudden great increase in speed. Another disadvantage is that all the energy present in the high-pressure line may be used by this particular hydromotor. This means that no more energy would come available for the other hydromotors, which would be a disadvantage. It is the object of the invention to avoid the above disadvantages. It is possible to achieve hereby that with the aid of the control means the speed and/or energy consumption of the hydromotor is restricted, so that the above-mentioned disadvantages do not occur.

SUMMARY OF THE INVENTION

The present invention is directed towards an apparatus for executing activities assisted by equipment driven by means of rotating or linear hydromotors, wherein the apparatus includes control means for restricting a fluid flow in a hydraulic transformer. In accordance with one aspect of the invention, the control means comprise at least one sensor. Direct or indirect measurement of the flow rate through the hydraulic transformer former with the aid of a sensor, is a simple manner for obtaining a signal that can be used by the adjustment means.

In accordance with a further improvement, the sensor forms a part of a flow restriction value in the high-pressure line to the hydraulic transformer and/or in the connecting line. In this embodiment simple means are used for limiting the fluid flow through the hydraulic transformer.

In accordance with another version, the sensor is coupled with adjusting means for, subject to the flow rate measured, adjusting the pressure in the connecting line. In this embodiment the fluid flow in the hydraulic transformer is limited, while simultaneously preventing loss of energy resulting from throttling the fluid flows.

In accordance with a further improvement, the pressure source comprises an aggregate wherein the control means are adjusted such that the hydromotor uses less power than an adjustable valve which is, for example, a portion of the power aggregate is capable of supplying. This embodiment achieves that there is always sufficient energy for all users coupled to the high-pressure line, so that these are able to continue to operate.

In accordance with a further improvement, the hydraulic transformer is provided with means to cause the pressure in the connecting line to oscillate around an adjusted valve. This embodiment achieves in a simple manner that low speeds can be realized with the hydromotors, even at high loads.

In accordance with a further improvement, the hydraulic transformer has a continuously variable setting controlled by the adjustment means. This embodiment achieves that the system can also be used for the recovery of energy in rapidly changing conditions, such as during deceleration of moving mass when a movable drive is used, and wherein the vehicle can be manipulated in the usual manner by the operator of the vehicle. The rapid change of the pressure ratio is an improvement also for the dynamic control and arrest of mass coupled with a motor.

In accordance with a further improvement, the adjusting means are provided with spring-activated elements for returning the hydraulic transformer into a neutral position wherein the pressure in the connecting line is minimal. This embodiment achieves that the hydromotor is not loaded if the control breaks down.

In accordance with a further improvement, the hydromotor is a linear cylinder connected with the hydraulic transformer by means of one connecting line which is provided with means for at tinder pressure supplying fluid from the low pressure line. If the setting of the hydraulic transformer is such that quick retraction occurs in the linear cylinder, it is possible by this embodiment to prevent the occurrence of an underpressure in the cylinder, which could cause cavitation.

In accordance with a further improvement, the apparatus is embodied according to claim 10. This embodiment provides the possibility that some of the motors can give a higher torque due to their being driven at a higher pressure than the system pressure prevailing in the high-pressure line. This allows the high-pressure line to be designed for a lower pressure, which is more economical.

The invention also comprises a hydraulic transformer for use in an apparatus, wherein a first fluid flow having a first pressure is transformed into a second fluid flow having a second pressure. Such a hydraulic transformer is disclosed in WO 9731185. The known apparatus has the disadvantage that if a fluid chamber is sealed by the face plate while there is considerable variation in the chamber's volume due to rotation of the rotor and there is no change in the amount of fluid that is present, the pressure in the fluid chamber may drop too low, which may cause cavitation. This drop in pressure may be reduced by making the angular deflection at which the fluid chamber is completely sealed, as small as possible. However, this has the disadvantage that there is more leakage along the face plate between the various line connections, which lowers the performance of the apparatus. It is the object of the invention to eliminate the aforementioned disadvantage and to this end the volume of the fluid chambers to be sealed by means of the face plate has a maximum value which is less than four times the minimum value of the volume to be sealed. By making use of the oil's elasticity and by ensuring that a relatively large minimum volume remains, cavitation is prevented, so that the mechanical life of the transformer is not shortened and there is hardly any noise nuisance.

In accordance with a further improvement of the hydraulic transformer, the volume of the fluid chambers to be sealed by means of the face plate is maximally three times as large as the minimum. By this embodiment cavitation is further prevented.

In accordance with a further improvement, the the rotor has nine or twelve fluid chambers. By this embodiment, fluctuations of the torque caused by the oil pressure in the fluid chambers and brought to bear upon the rotor are kept at a minimum, as a result of which the axial force the rotor brings to bear upon the face plate, is also kept at a minimum. This facilitates adjustment of the hydraulic transformer.

In accordance with a further improvement, the face place gates and the rotor gates are dimensioned such that at least two rotor gates are of the same size and all three walls between the rotor gates simultaneously seal off a free plate gate. This embodiment further limits the fluctuations of the torque brought to bear upon the rotor.

In accordance with another version of the hydraulic transformer, the transformer transforms a first fluid flow having a first pressure into a second fluid flow having a second pressure. Such an apparatus is disclosed in WO 9731185. The known apparatus is limited in its applications because it is not possible over a large working area to completely transform the pressure ratios of two of the line connections. It is the object of the apparatus according to the invention to eliminate this disadvantage, and to this end is embodied according to the characterizing part of claim 15. By this embodiment, the pressure ratio between the line connections over a large working area can completely be reversed through the rotation of the face plate, which broadens the applicability of the apparatus.

In accordance with a further improvement of the apparatus, the face plate at the side of the fluid chambers is bordered by a first separating surface and at the side facing away from the second chambers by a second separating surface. The first separating surface comprises at least three rotor gates located at a first radius and being in communication with three face plate conduits, wherein the third face plate conduit is in communication with a housing gate located at a third radius which is different from the second radius. This embodiment is a simple manner of providing conduits whose orifices are sufficiently large, so that little loss of current occurs at the various convenient rotation positions of the face plate.

In accordance with one version, the third face plate conduit is in communication with a housing gate at the circumference of the face plate. This embodiment achieves that pressure fluctuations in the third face plate conduit do not influence the axial forces around the face plate, making it simple to bring the same into equilibrium.

In accordance with one version, the third face plate conduit is in communication with a housing gate near the rotation axis of the face plate. This embodiment makes it possible for the face plate to be compact.

In accordance with a further improvement, at the second separating surface, the housing is provided among other things with four face plate gates. By this embodiment the two housing gates located at the first radius are in all the face plate's positions in communication with large conduits in the housing, with the result that the flow resistance is minimal.

In accordance with a further improvement the hydraulic transformer is embodied according to claim 20. By this embodiment the shuttle valve is operated quite simply when the face plate is readjusted.

BRIEF DESCRIPTION OF THE DRAWINGS

The invention will be elucidated with reference to an illustration of an embodiment, wherein.

DETAILED DESCRIPTION OF THE PREFERRED EMBODIMENTS

Similar parts in the various figures are identified as much as possible by identical reference numbers.

Figure 1:
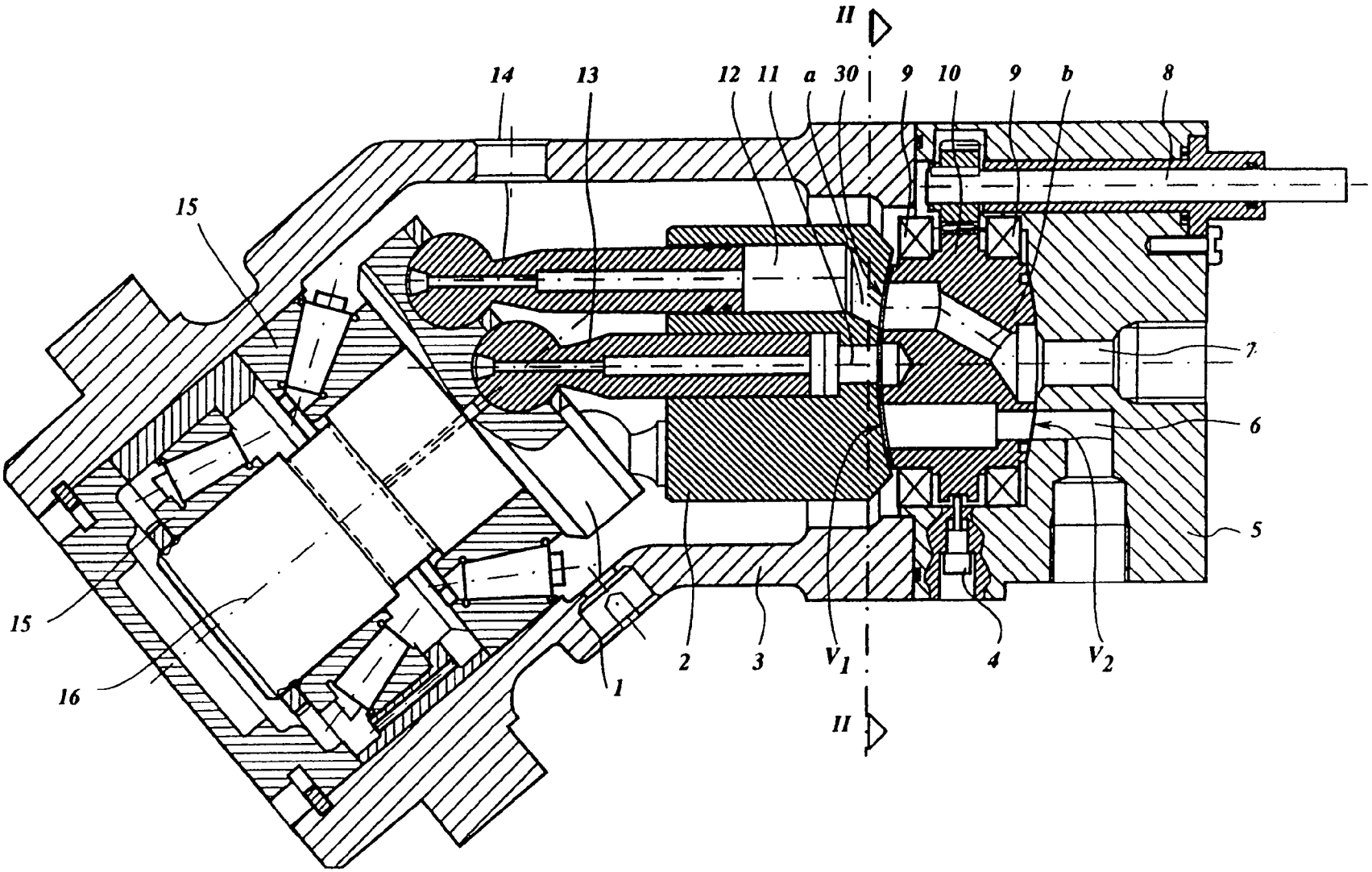
FIG. 1 shows a cross section of a hydraulic transformer based on an axial piston pump.

FIG. 1 shows a hydraulic transformer. It shows a bent housing 3 in accordance with the bent housing of an axial piston pump, from which said hydraulic transformer is more or less derived. At one side in the bent housing 3, a swivel axle is rotatably mounted by means of two swivel axle bearings 15. The swivel axle 1 is able to freely rotate around a rotation axis 16. The bent housing 3 comprises also a rotatable rotor 2, mounted on an axis 13. The rotor 2 rotates around the axis 13 which is mounted on the swivel axle 1. A rotation axis 11 of the rotor 2 forms an angle with the rotation axis 16 of the swivel axle 1, whereby said rotation axes 11 and 16 intersect.

The swivel axle 1 is also provided with pistons 14, which can move in the longitudinal direction in the cylindrical chambers 12 of the rotor 2. The pistons 14 couple the rotation of the swivel axle 1 with the rotation of the rotor 2. The joint rotation of the rotor 2 and the swivel axle 1, and the fact that the rotation axis 11 of the rotor 2 and the rotation axis 16 of the swivel axle 1 form an angle, cause the pistons 14 in the cylindrical chambers 12 to move to and fro, thereby causing the volume of the cylindrical chambers 12 to vary between a minimum and a maximum. Via a rotor conduit a, each of the cylindrical chambers 12 is in communication with face plate gates 30 located in a sealing surface V1.

The rotor 2 is sealingly fastened to a face plate 10 by means of the sealing surface V1, and the face plate 10 is sealingly fastened to a housing 5 by means of a sealing surface V2. The housing 5 and the bent housing 3 are attached to one another by means of bolts, which are not shown. The face plate 10 is rotatably mounted in the housing 5 by means of face plate bearings 9, whereby it is able to rotate around a rotation axis 11 which coincides with the rotation axis 11 of the rotor 2. The bearings 9 are designed such that the face plate 10 is able to move in the direction of the rotation axis 11, that in the cylindrical chambers 12 the rotor 2, under the influence of the oil pressure pushes, among other things, against the face plate 10, and the face plate against the housing 5. Any oil leakage along the surfaces V1 and V2 is thereby avoided as much as possible.

By means of an adjusting shaft 8, the face plate 10 can be rotated and thus adjusted. The rotation of the face plate 10 is limited to approximately 180° by means of a pin 4. In the housing 5 radial housing bores 6 are provided and a central housing bore 7.

The bearings 9 of the face plate 9 are necessary to prevent the face plate from tilting under the influence of the asymmetrical pressures in the sealing surfaces V1 and V2. These asymmetrical pressures develop due to the varying oil pressures in the various orifices in the face plate 10 and they depend, among other things, on the rotation position of the face plate 10. Should the face plate 10 be able to tilt, inadmissible leakages could develop along the surfaces V1 and V2. The bearings 9 are therefore designed such that the face plate 10 is able to move in the axial direction but cannot tilt. In order to further minimize the leakage in the surfaces V1 and V2 ensuing from tilting of the face plate 10 which could occur due to play in the bearings 9, the surfaces V1 and V2 are spherical with the centre of the sphere being located on the rotation axis and the surface of the sphere being directed outward. This diminishes the extent to which tilting affects leakage.

The rotor 2 can rotate around the rotation axis 11, thereby varying the volume of the cylindrical chambers 12. Via the face plate gates 30 and the conduits b in the face plate 10, the cylindrical chambers 12 are in communication with one or two of the radial housing bores 6 of the central housing bore 7. The face plate 10 is kept in the housing 5 at a more or less constant rotation position, unless said face plate is being adjusted by means of the adjusting shaft 8. Due to the effect of the different pressures prevailing in the central housing bore 7 and the radial housing bores 6, the pressure in the various cylindrical chambers 12 varies, with the result that at the various chambers different forces are brought to bear upon the rotor 2, causing the rotor 2 to rotate. This induces the flow of oil through the housing bores 6 and 7, the pressure ratio in the various housing bores depending, among other things, on the position of the face plate 10. The sealing surfaces V1 and V2 are, in accordance with the known art, finished with care, so that there is hardly any leakage between the rotor 2 and the face plate 10 or between the face plate 10 and the housing 5 respectively. The cylindrical chambers 12 have a varying volume which during rotation of the rotor 2 is periodically sealed by the face plate 10 at the face plate gate 30. While being sealed, the volume in the cylindrical chambers 12 still varies, causing the pressure to rise or drop due to the rotation of the rotor 2. If the cylindrical chamber 12, sealed by surface V1, has a dead volume of at least 25 to 50% of the stroke volume of the piston 14, there is no cavitation which shows that the pressure drop is staying within acceptable limits. This means that the maximum volume sealable by the face plate is smaller than three to five times the minimum of the sealable volume. Due to the fact that the expanding oil prevents the pressure in the cylindrical chamber 12 from dropping too low, cavitation is prevented. This in turn reduces wear and the noise level.

As a result of the cylindrical chambers 12 being sealed and of there being a limited number of cylindrical chambers, for example, in this case 7 chambers, the rotation of the rotor 2 caused by the pressure variations in the cylindrical chambers 12 and the ensuing fluctuation of the torque on the rotor 2, is not completely regular and are the rotation of the rotor 2 and the swivel axle 1 subject to deceleration and acceleration. This will cause the hydraulic transformer to exert a varying torque on its bedplate which, through resonance, may cause noise nuisance. Noise nuisance can be prevented by placing the hydraulic transformer on rubber blocks, thereby allowing it to make small movements and by making the lines flexible.

Figure 2:
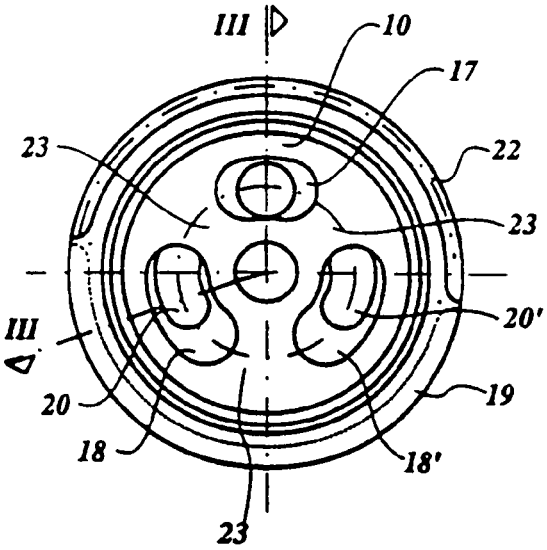
FIG. 2 shows a view according to II—II of the face plate of the hydraulic transformer of FIG. 1.

FIG. 2 shows the face plate 10 in the sealing surface V1 with a high-pressure rotor gate 17, a first rotor gate 18 and a second rotor gate 18'. These gates collaborate with the face plate gates 30. Between the rotor gates 17, 18 and 18' wide walls 23 are provided, the width of the wide wall 23 being such that a cylindrical chamber 12 via the face plate gate 30 is always only in contact with one of the rotor gates 17, 18 or 18'. As discussed above, it has been shown that when the rotor 2 rotates, the torque exerted by the swivel axle fluctuates as a result of the different fluid pressures in the cylindrical chambers 12. If there are three rotor gates 17, 18 and 18', this undesirable fluctuation can be limited by having as many cylindrical chambers 12 as possible. By providing cylindrical chambers 12 in multiples of three, the axial force exerted by the rotor 2 on the face plate 10 is minimal, resulting in a reduction of wear. Preferably there are nine or twelve cylindrical chambers because this is the number with which to achieve the above-mentioned advantages in the most optimal manner.

Over a curve of, for example, approximately 180° the circumference of the face plate 10 is provided with toothing 22 and the other 180° are provided with a groove 19 interacting with the earlier-mentioned pin 4. The adjusting shaft 8 engages the toothing 22. The lengths of the rotor gates 17, 18 and 18' may be identical but, depending on the application, may also be different. Due to the groove 19 and the toothing 22 provided over half of the circumference, the rotation of the face plate 10 in the housing 5 is restricted to about 180°, the high-pressure rotor gate 17 being able to rotate over 90° to both sides in relation to the position in which the volume of the cylindrical chamber 12 is the smallest (this position is called the Top Dead Centre TDC). By shortening the groove 19 or by using two pins 4, the maximum rotation angle can be reduced to less than 90° either side. This limits the maximally attainable pressure ratios, so that, for example, the pressure in the first or second rotor gate is restricted to twice the pressure in the high-pressure rotor gate, or whereby the maximum pressure in the one load direction can be made different to that in the other direction.

In accordance with an embodiment of the face plate 10, the rotor gates 17, 18 and 18' and the walls 23 are dimensioned such that the axial forces from the rotor 2 on the face plate 10 are at all rotation positions as low as possible. The rotor gates 18 and 18' are identical in size and symmetrical in relation to one another, and the centres of the walls 23 form an angle with one another which is a multiple of the pitch angle between the rotor gates 30, distributed evenly over the circumference. The width of a wall 23 in the direction of rotation is approximately, with a tolerance of one degree, the same as the width of a face plate gate 30 in the direction of rotation. In this embodiment the rotor 2 may also assume a rotation position in which the walls 23 are covered by the portion of the rotor 2 that is located between the face plate gates 30. The oil leakage between the rotor gates 17, 18 and 18' is then minimal. In the situation where the face plate 10 is adjusted such that, subject to the load from the users connected to the hydraulic transformer there is no oil flow, the pressures in the cylindrical chambers 12 and the forces on the rotor 2 will cause the same to come to a stand-still, because this is the most stable position.

The face plate 10 is rotated by means of the axle 8. In order to realize an engagement without play between the toothed wheel on the axle 8 and the toothing 22, several known measures can be taken, such as rendering the centre-to-centre distance between the axle 8 and the rotation axis of the face plate 10 adjustable. To this end the bush in which an axle 8 rotates is designed in the known manner as eccentric bush. The axle 8 may be driven by means of a manually operated lever. As will be shown below, the axle 8 may also be driven by means of a servo-motor comprising a control system. Alternatively, the manual operation may be limited by blockages which are adjustable by means of a control system.

Figure 3:
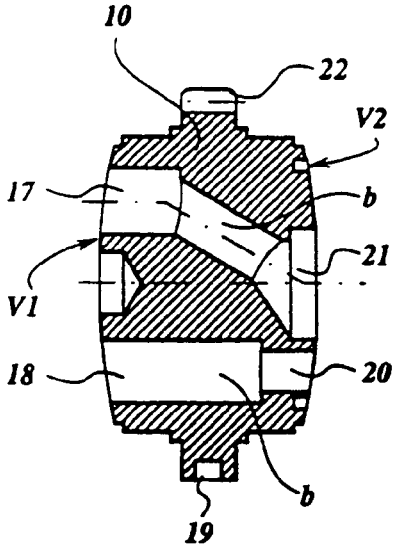
FIG. 3 shows a cross section according to III—III of the face plate of the hydraulic transformer of FIG. 2.

FIG. 3 shows a cross section of the face plate 10. It can be seen how via a conduit b, the high-pressure rotor gate 17 is in communication with the centrally positioned high-pressure housing gate 21. Via a conduit b the first rotor gate 18 is in communication with a first housing gate 20, located at a radius at the side of the gate plate 10 facing the housing 5.

Figure 4:
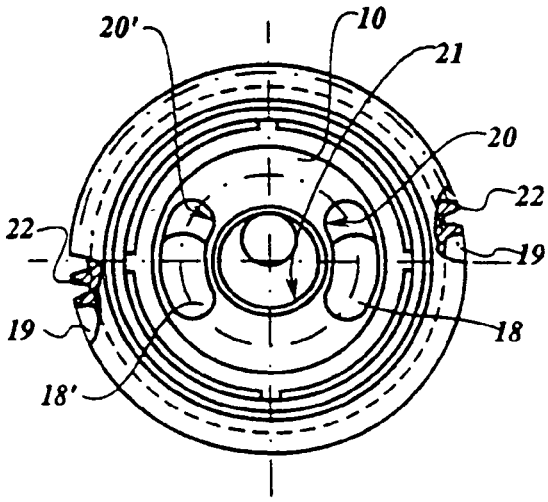
FIG. 4 shows the face plate of FIG. 2 as seen from the opposite side.

FIG. 4 shows the view of the surface V2 of the face plate 10. The position of the first housing gate 20, a second housing gate 20' and the high-pressure housing gate 21 are visible. the length of the first housing gate 20 and the second housing gate 20' is slightly less than 90°.

Figure 5:
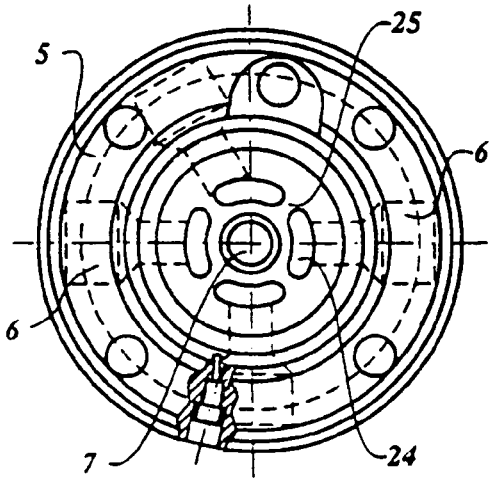
FIG. 5 shows a view according to II—II of FIG. 1 of the housing of the hydraulic transformer without face plate, FIG. 6 schematically shows the coupling between the face plate conduits, the gates in the housing and a motor coupled with the pressure transformer.

In FIG. 5 the housing 5 is shown, illustrating the connections of the radial housing bores 6 and the central housing bores 7, which terminate in the sealing surface V2 with a face plate gate 24. In the centre of surface V2 a central housing bore 7 is provided, and surrounding it are the four evenly distributed face plate gates 24. Between the face plate gates 24 there is a narrow wall 25. The central housing bore 7 adjoins the high-pressure housing gate 21, and the face plate gates 24 adjoin the first housing gate 20 and second housing gate 20'. The dimensions of the first housing gate 20 and the second housing gate 20' are such that they cover approximately one face plate gate 24. It is essential that in the various positions of the face plate 10, always two face plate gates 24 work together such as to allow the oil to flow from the first housing gate 20 or the second housing port 20' with little loss of current.

Figure 6:
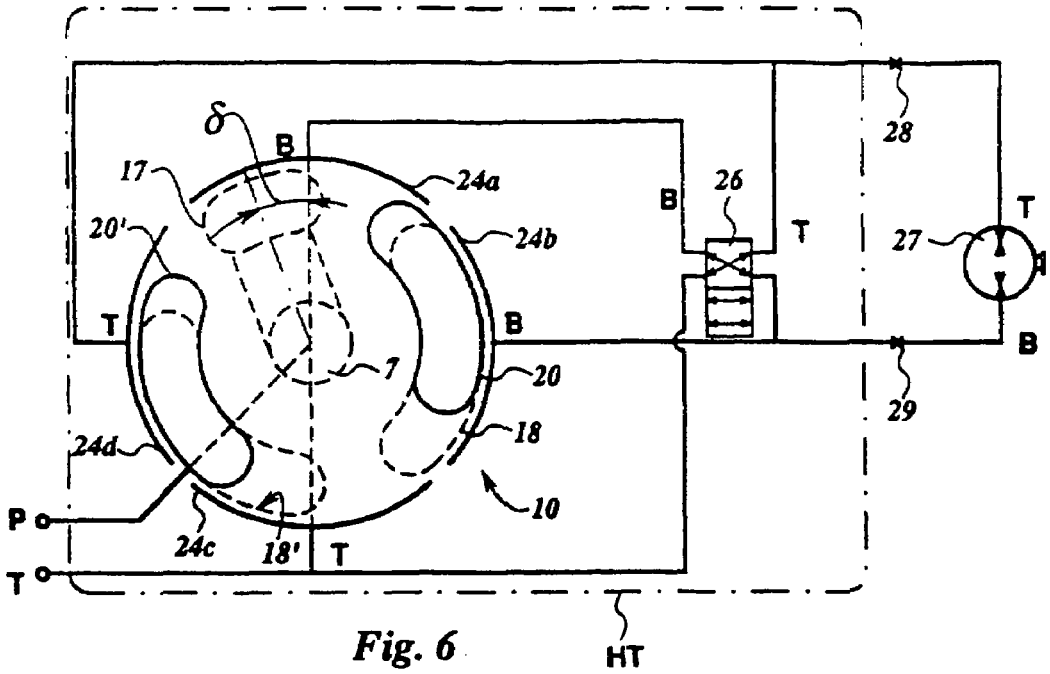
Figure 7:
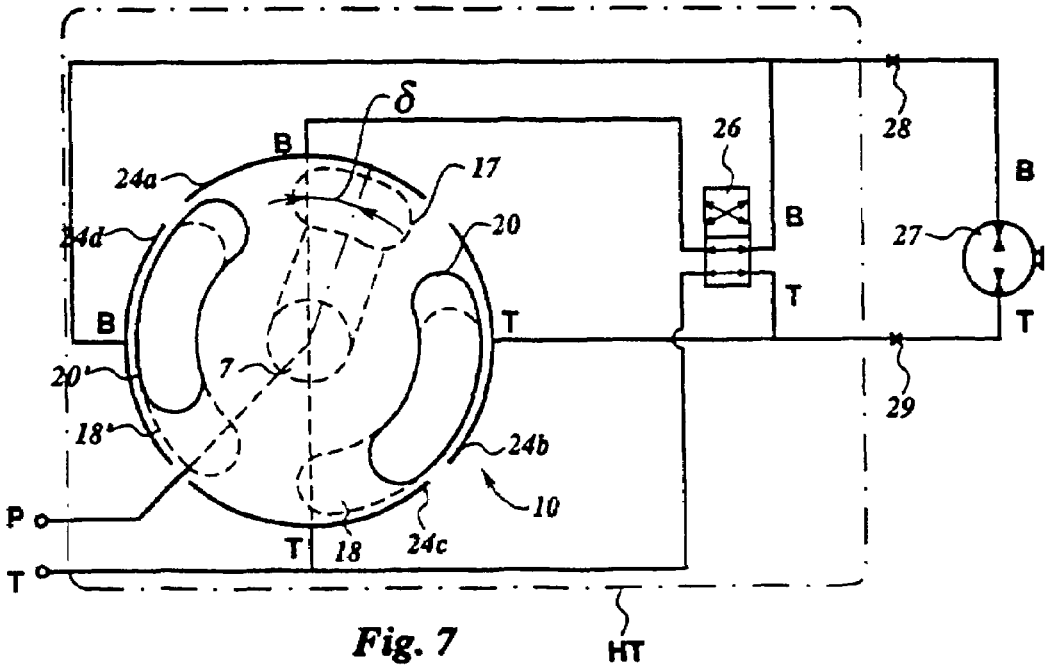
FIG. 7 shows a schematic view as in FIG. 6, with the face plate being in a different position in relation to the housing, and the motor encountering a reversed load.

FIGS. 6 and 7 schematically show the connections of a hydraulic transformer HT, the manner in which they are provided with energy via a feed pressure P, and the oil discharge having a tank pressure T, and how a rotating motor 27 is connected in the case of a varying load device. FIG. 6 schematically shows the face plate 10, positioned at a adjusting angle δ. The face plate gates 24 are represented schematically as the curved lines 24*a*, 24*b*, 24*c* and 24*d* and correspond to the face plate gates 24 shown in FIG. 5. The first housing gate 20 works together with two face plate gates 24*a* and 24*b*. Due to the adjusting angle δ, the first housing gate 20 has a working pressure B, the second housing gate 20' has the tank pressure T, if the high-pressure cylinder gate has a feed pressure P. Said pressures bear a certain relation to one another which, among other things, depends on the adjusting angle δ. For the working pressure B to be able to take on a value that may exceed that of the feed pressure P by approximately 50%, it is necessary that the adjusting angle δ can be adjusted to a maximum of 90°. The first housing gate 20 is then in open communication with the two face plate gates 24*a* and 24*b*. Via a shuttle valve 26, said conduit gates 24*a* and 24*b* are in communication with one another and are coupled to a first connection 29 of the rotating motor 27. In a similar manner the face plate gates 24*c* and 24*d* connected with the second housing gate 20', are connected with a second connection 28 of the rotating motor 27. When comparing FIGS. 6 and 7, wherein the adjusting angle δ in FIG. 7 has acquired an opposite value with the result that the pressures on the rotating motor 27 have also acquired an opposite value, the necessity for the first housing gate 20 to also be in communication with the face plate gate 24*c* becomes obvious, and for that purpose the shuttle valve is turned.

The adjustment of the shuttle valve 26 depends entirely on the position of the face plate 10 and may thus be coupled thereto. This may be a mechanical coupling; the face plate 10 may, for example, be a cam disc which operates the shuttle valve 26. It may also be an electro-mechanical mechanical or electrohydraulic coupling. The face plate 10 may also be provided with gates (not shown) which work together with orifices in the housing so that they have the effect of valve 26. Instead of coupling the shuttle valve 26 with the face plate 10, it is also possible to adjust the shuttle valve 26 in relation to the pressure at the motor connections 28 and 29, since they also depend on the adjusting angle δ.

Apart from the above embodiment having a central housing bore 7 working together with the high-pressure housing gate 21, there are also other possible embodiments. For example, a first alternative embodiment is that instead of the central housing bore 7 in surface V2, a annular conduit is provided in housing 5 or in the face plate 10, working together with a bore in the face plate 10 or the housing 5 respectively. Said annular conduit is then provided at a different radius to that of the face plate gates 24. A second alternative embodiment is, for example, that the above-mentioned annular conduit is provided at the circumference of the face plate 10, either in the face plate 10 or in the housing 5. Said annular conduit then also works together with a bore provided in the housing 5 or in the face plate 10, respectively. This embodiment has the advantage that if the pressure in the annular conduit varies, the forces exerted in the direction of the rotation axis 11 on the face plate 10, do not vary; as a result of which the forces on the face plate 10 ensuing from the pressures in the various gates can be equilibrated more easily in the different work situations. Instead of the above-mentioned embodiment comprising an annular conduit and a bore, with the annular conduit extending over the maximal rotation angle of the face plate 10, it is also possible to provide two annular conduits, one in the housing and one in the face plate 10, the length of the annular conduits being such as to allow the face plate 10 to make the desired rotation.

In the embodiment shown, the face plate 10 is bearing-mounted in bearings 9. The face plate may also be provided with different bearings, always ensuring that rotation and axial displacement are possible and that tilting is prevented. For example, it is possible to use static oil pressure bearings, or to provide an axle or tube at the rotation axis 11 projecting into the housing 5 and being bearing-mounted in the housing, and which can simultaneously be employed for the rotation of the face plate 10. The tubular axle may then be in coupled with the central housing bore 7.

The above-described construction comprising a shuttle valve 26 is in particular necessary if the face plate 10 is required to rotate over a wide angle, as is the case in the embodiment shown. If the rotation angle is permitted to be smaller, for example, because chambers are used whose volume acquires a minimum and a maximum value twice or more often per rotator rotation, and if the embodiment of the face plate is adapted, the rotation the face plate is required to make to operate is smaller, and it is not necessary to use a shuttle valve to ensure that the flow orifices are large enough. However, there may be occasions when their use will nevertheless give better results.

In the interior of the bent housing 3, leak-off oil will flow along the separation surfaces V1 and V2. Since the bent housing 3 does not have a rotating exiting axle with a pressure-sensitive seal—as the swivel axle 1 is not driven—the development of an overpressure in the bent housing 3 is permissible. As the overpressure may be equal or higher than the tank pressure T, the interior of the housing 3 is, in a manner not shown, in communication with the face plate gate 24*c* and consequently with the tank connection T.

Figure 8:
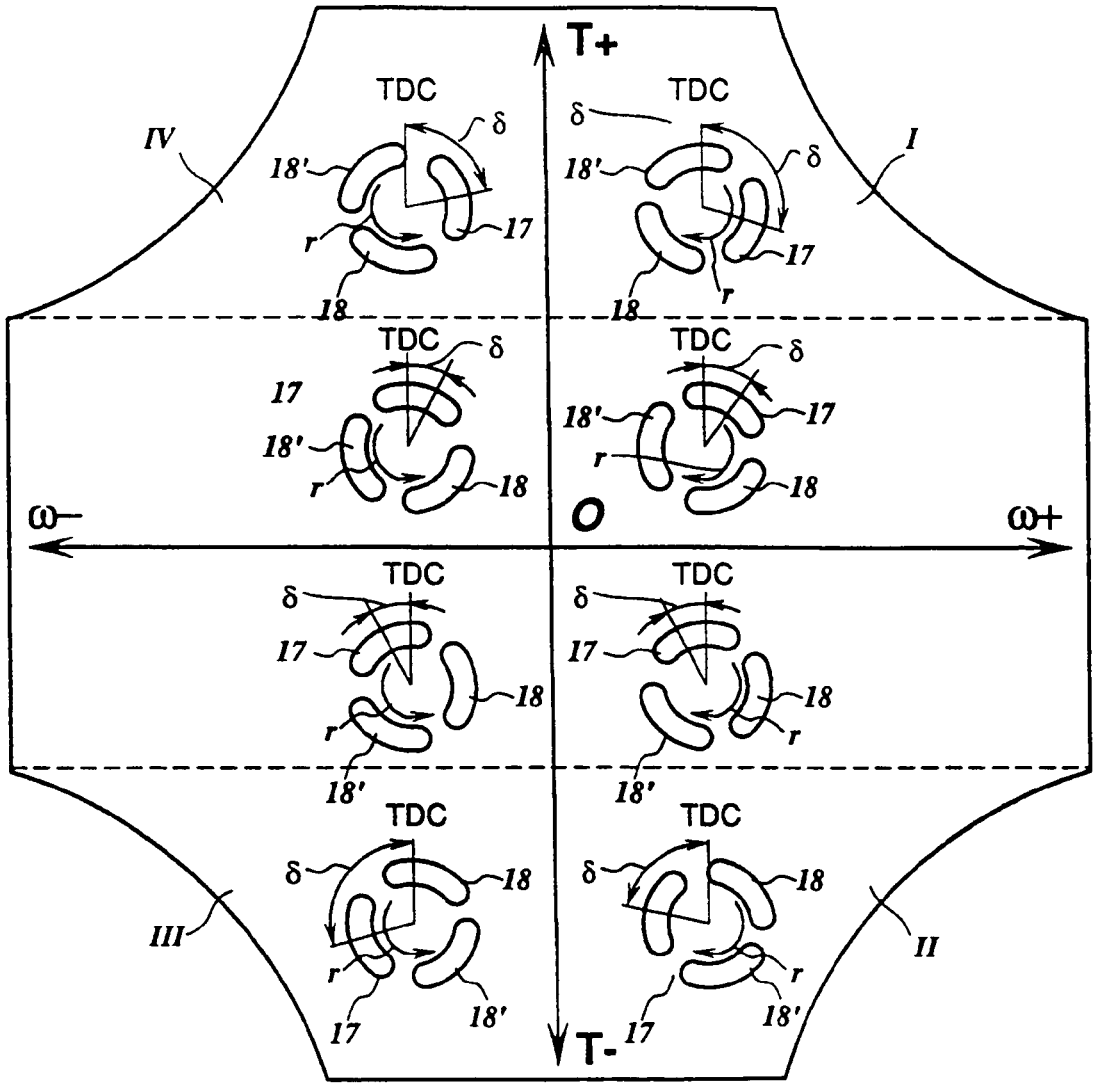
FIG. 8 shows a schematic view of the different positions of the face plate in the various deployment conditions and load situations of the motor coupled with the hydraulic transformer.

FIG. 8 shows schematically the application of the hydraulic transformer when the same is connected to a rotating motor 27, as indicated in the FIGS. 6 and 7. The description is applicable in a similar manner if instead of a rotating motor 27 a double-acting hydraulic cylinder as linear motor is coupled to the hydraulic transformer. Instead of rotation and torque, displacement and load are then involved.

In the diagram of FIG. 8 the rotation speed of the motor 27 is plotted in four quadrants on the horizontal axis against the loaded torque. In a first quadrant I the motor moves forward at a positive speed ω, driving, for instance, a device or object at a positive torque T. In the second quadrant II the motor moves forward at a positive speed ω, the device or object mass is being decelerated at a negative torque T. In the third quadrant III the motor moves in the opposite direction and the speed ω is negative and the device or object is driven in that direction also, such that the torque T is also negative. In the fourth quadrant IV the direction of movement of the device or object is still opposite so that the speed ω is negative, but this negative speed is being decelerated due to the torque being positive.

The torque T of the motor 27 is limited by the maximally allowable pressure in the system which is formed by the hydraulic transformer, the coupling lines and the motor; the speed ω is limited by the allowable speed of the motor, and each quadrant is also limited by the maximum power to be produced, which is shown by the hyperbolical boundary of the quadrants.

As shown in the diagram, the pressure ratio at the rotor gates 17, 18 and 18' is determined by the rotation position of the face plate 10, in the diagram indicated by the adjusting angle δ in relation to TDC, which is the Top Dead Centre, that is the position of the rotor 2 at which the volume of the cylindrical chamber 12 is maximal. As discussed above, the first rotor gate 18 and the second rotor port 18' are joined with the connections of the motor 27, and the feed pressure P is joined with the high-pressure rotor gate 17.

The rotation of the motor 27 at rotation speed ω occurs through the effect of the torque T, which torque T depends, among other things, on the resistance and the acceleration and deceleration of the devices and objects driven by the motor 27. The rotation of the motor 27 causes the flow of oil and also the rotation of the rotor 2 at a rotation speed r. The direction of the rotation and the speed r of the rotor 2 depend on the direction of the rotation and the rotation speed ω of the motor 27.

In order to be able to react to varying loads, the face plate has to be quickly adjustable and rotatable. For example, when the hydraulic transformer is used with the motor in a mobile drive, it is essential that it is possible to quickly switch from movement to deceleration, and to this end it is necessary that within 500 msec the load of the motor 27 can be completely reversed by means of a 180° rotation of the face plate 10. This means that within 500 msec the face plate 10 can be turned 180° from the first extreme operative position to the second extreme operative position, transforming the maximal working pressure from the first motor connection 28 to the second motor connection 29 and vice versa.

In order for the system to respond properly to load fluctuations due to, for example, varying loads, a feed-back control system is used for the drive of the face plate, wherein feedback may be effectuated through measuring the speed of the motor (speed feedback) or through measuring the load of the motor (load feedback).

Speed feedback may ensue when the rotation speed r of the rotor is measured or when the pressure drop at throttling resulting from an oil flow, is measured. Load feedback may ensue when the pressure difference between the first housing gate 20 and the second housing gate 20' is measured. The drive of the face plate 10 and the applied control system are attuned such that a response frequency of minimally 3.5 Hz, and preferably a response frequency of minimally 7 Hz is realized. This means that the face plate 10 has to be able to rotate quickly from the intermediate position to the maximum position, in other words 900, for instance within 100 to 200 msec. To this purpose the drive of the face plate 10 may comprise an electric servomotor coupled to the adjusting axle 8. Alternatively, the face plate 10 can be adjusted by means of a hydraulic cylinder comprising a rack which engages (not shown) the toothing 22 of the face plate 10, and which is adjustable by means of a servo valve.

Figure 9:
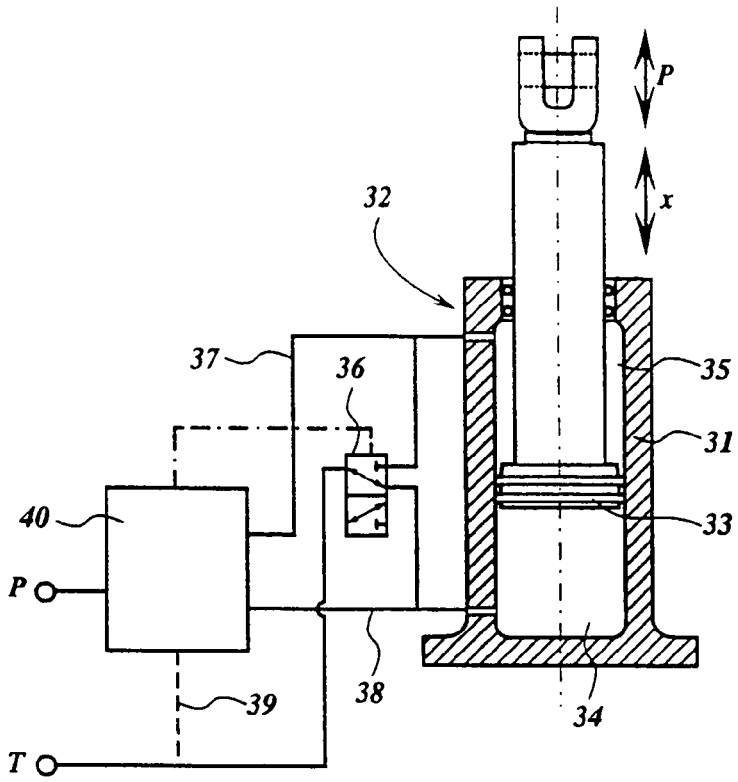
FIG. 9 shows a schematic view of a second embodiment of a hydraulic transformer, coupled with a double-acting hydraulic cylinder, FIG. 10 schematically shows a third embodiment of a hydraulic transformer with a single-acting hydraulic cylinder.

FIG. 9 shows a double-acting hydraulic cylinder 32 comprising a housing 31 with a vertically movable piston 33. The piston is movable in both directions x and in doing so, is able to exert a force P in both directions. Thus the double-acting hydraulic cylinder 32 can be used in a similar manner as in the application of the rotatable hydromotor described in FIG. 8, and is therefore suitable for four-quadrant use. At the bottom side, the housing 31 and the piston 33 form a chamber 34 which via a connecting line 38 is in communication with a connection of a hydraulic transformer 40. Via a connecting line 37, a chamber 35 formed by the top of the piston 33 and the housing 31, is in communication with the hydraulic transformer 40. The hydraulic transformer 40 is a simple embodiment of the hydraulic transformer described in the preceding figures. The simplification consists in the fact that the line connections such as the high-pressure line P and the connecting line 37 and 38 are in communication with the three conduits in the face plate. To ensure that in certain load situations the mass continues to be appropriately equilibrated in the hydraulic transformer 40, it is necessary to transport fluid from or to the tank connection T. To ensure that said transport to the pressure-less line of the hydraulic transformer 40 takes place, a valve 36 is provided which operates via the position of the face plate or the pressure in the connecting lines 37 and/or 38. The leak-off oil in the hydraulic transformer 40 is discharged to the tank connection T via a leak-off oil drainage 39.

Figure 10:
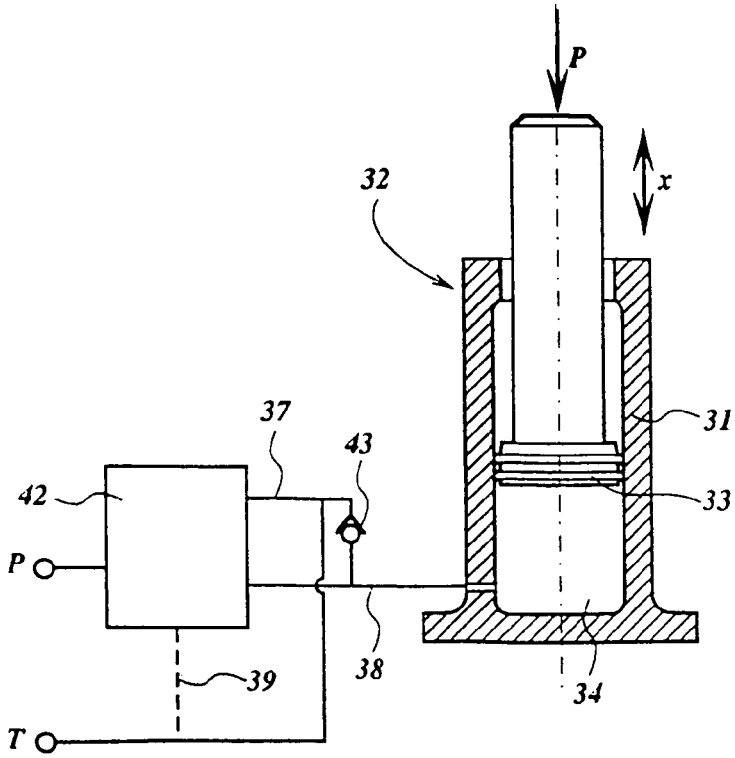

FIG. 10 shows a single-acting hydraulic cylinder 41 comprising a housing 31 and a piston 33. The piston 33 is movable in both directions x and is able to exert a force in one direction P. Thus the single-acting hydraulic cylinder 41 is only suitable for use in a first and fourth quadrant as shown in FIG. 8, where instead of torque and rotation one has to read load and displacement. A connection line 38 couples the single-acting hydraulic cylinder 41 to a hydraulic transformer 41, which is comparable to the above-mentioned hydraulic transformer 40, and in which the rotation of the face plate is limited so that the pressure in the connecting line 37 never exceeds the pressure in the tank connection T. Due to inertia of the piston 33 or the mass connected with it, it is possible that when the face plate is being adjusted, the connecting line 38 becomes pressure-less to the extent that said pressure line 38 or the chamber 34 become cavitated. In order to avoid this, the connecting line 38 is in communication via a non-return valve 43 with the tank connection T.

Figure 11:
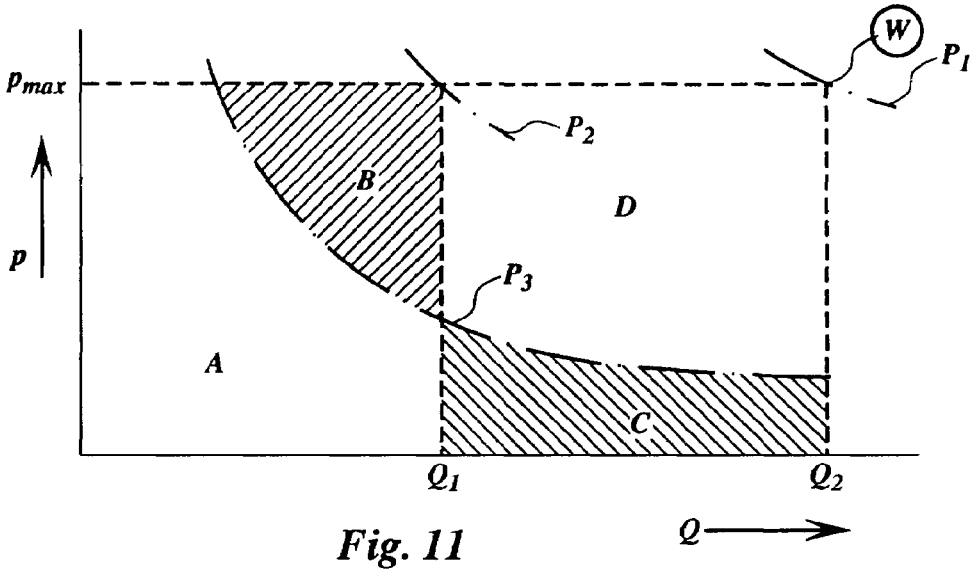
FIG. 11 shows a diagram of the working range of a hydraulic transformer, FIG. 12 schematically shows an embodiment of a hydraulic transformer with a control system, and a hydromotor.

The diagram of FIG. 11 shows the working range of a hydraulic transformer, wherein the same is fed from a high-pressure line having a constant pressure P, and is coupled to a motor, for example, a rotating hydromotor. The constant working pressure P is generated by means of an aggregate. In the diagram the pressure P is plotted against the volume oil flow Q to the hydromotor. To protect the hydraulic transformer, the connecting lines and the motor against overloading, the pressure is limited to $P_{max}$ by restricting the rotation of the face plate. As already known, $P_{max}$ may be higher than the pressure in the high-pressure line P, so that in a limited number of places in an installation, it is possible to use motors with a higher allowable pressure. The values for pressure P and volume flow Q shown in the diagram correspond to the load from the hydromotor and the rotation speed of the hydromotor respectively. The power produced by the hydraulic transformer and thus also by the hydromotor is indicated by the dash-dot-lines $P_1$, $P_2$ and $P_3$.

The motor coupled with the hydraulic transformer is controlled by varying the pressure, which causes the motor to rotate and the volume to flow through the hydraulic transformer. In a high-pressure line having a constant pressure P, the volume flow may increase without limitation as long as the load produced by the motor is greater than the load used by the machine that is being driven. The motor could develop an inadmissible speed, or inadmissibly much power could be used from the high-pressure line. The place in the diagram indicated by W is the used power P1 and the fluid flow $Q_2$. The working range is then A+B+C+D, and it is the objective to limit this. By limiting the fluid flow Q to $Q_1$, the maximum power produced becomes P2 and the working range becomes A+B. This may result in the hydromotor using too much power, so that the aggregate cannot supply enough oil. By limiting the power to be produced by the hydraulic transformer to $P_3$, the working range is reduced to A+C; it should be borne in mind, however, that there is no restriction to $Q_2$, so that during load reduction the revolutions of the hydromotor may still be inadmissibly high. By combining the limitation of the fluid flow and the power, the working range is reduced to A.

Figure 12:
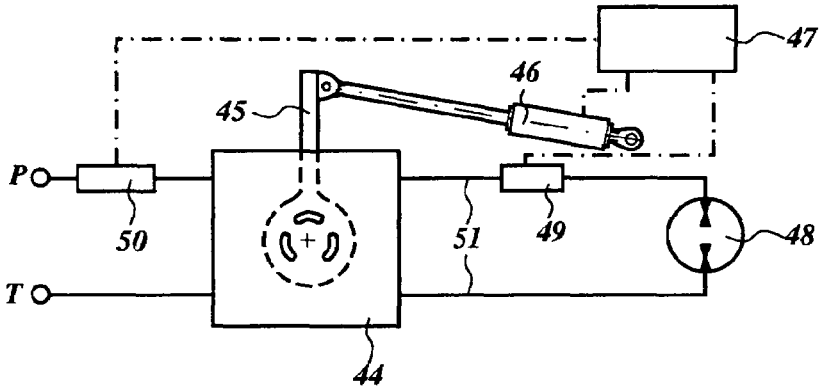

FIG. 12 shows how the working range can be limited by means of a control system. A schematically indicated hydraulic transformer 44 comprises an adjustment mechanism for the face plate, which adjustment mechanism 45 is operated by an actuator 46. The actuator 46 is controlled by a control system 47 which is designed to make the motor move in a particular manner. In the high-pressure line from a pressure source P to the hydraulic transformer 44, a sensor 50 is provided which is able to measure the flow rate, or which at least emits a signal if the flow rate exceeds a set value. The hydraulic transformer 44 is connected with a hydromotor 48 by means of connecting lines 51. The connecting lines 51 are provided with a sensor 49, which is similar to sensor 50. The sensors 49 and 50 are coupled with the control system 47.

By measuring the oil flow to the hydraulic transformer 44 by means of the sensor 50, the power used is measured and the face plate can be adjusted by means of the actuator 46 such that the power used by the hydraulic transformer can be limited to a set value. By measuring the oil flow in the connecting line 51 by means of the sensor 49, the fluid flow can be limited. Instead of measuring the fluid flow directly in the connecting line 51, it can also be determined in another manner, for example, by counting the revolutions of the rotor of the hydraulic transformer 44 or of the hydromotor 48.

In addition to the embodiment described above it is also possible for the control system 47 to comprise an algorithm for calculating the various flow rates and/or the power used. For this purpose, the pressure in the high-pressure line is known in the control system 47, for example, via a sensor or as preset value; for example, via the position of the actuator 46, the position of the face plate is known and one of the rates in the system, such as the flow rate in the high-pressure line to the hydraulic transformer 44, the flow rate in a connecting line 51, the rotation speed of the hydraulic transformer's rotor or the speed of movement of the motor 48, are known.

Figure 13:
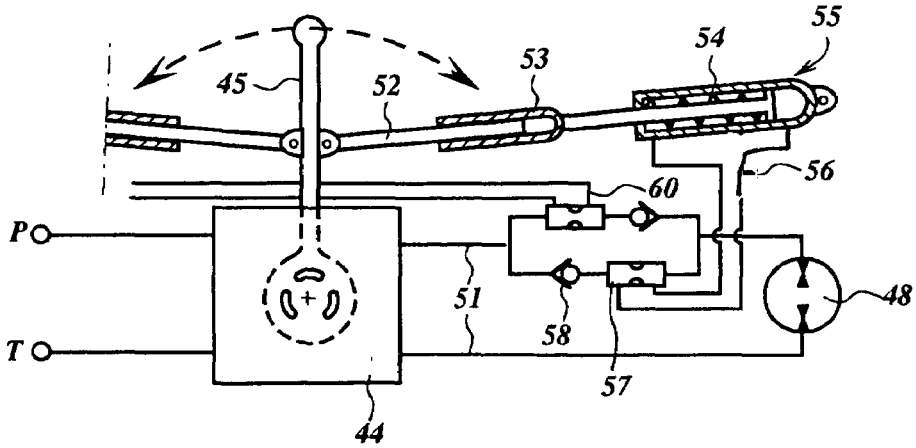
FIG. 13 shows a simplified version of the embodiment of FIG. 12.

FIG. 13 shows a simplified embodiment for limiting the fluid flow through the hydraulic transformer 44, wherein the adjustment mechanism 45 of the face plate is operated manually. In order to limit excessively high speeds of the motor 48 controlled by the hydraulic transformer 44, a mechanism is provided for restricting the stroke of the adjustment mechanism 45 if the flow rate in the connecting lines 51 exceed a preset value. To the adjustment mechanism 45 a rod 52 is attached, which can slide into a bush. The bush 53 is fastened to a hydraulic cylinder 55, whose piston, when there is insufficient pressure in a signal line 56, is retained in an extreme position by a spring 54. In this position the rod 52 can move freely in the bush 53 and the adjustment mechanism 45 can be moved freely. In both flow directions in the connecting line 51, a restriction 57 is built in after a non-return valve 58, which above a particular flow rate in the signal line 56 or a signal line 60, causes a build-up of pressure. The pressure in the signal line 56 pushes the piston in opposition to the spring pressure in the hydraulic cylinder 55 toward its second extreme position, and pushes the adjusting means 45 into a direction such that the flow rate will decrease.

If the flow rate is too high in the opposite direction, the pressure will increase in the signal line 60, so that an identical cylinder will move the adjustment mechanism 45 into the opposite direction.

In addition to, or instead of limiting the flow rate as shown here, the power can be limited in a similar manner.

The above-described embodiment comprising limitation of power to be produced by a motor, is deployed in situations where several motors and other users are coupled to a common high-pressure line. By means of the control system 47 it is possible to limit the power used by the various motors which may, for instance, be necessary if the hydraulic power to be produced by an aggregate is limited, and if parts of the installation always have to be available for use.

In addition to the above-described limitation of power and/or speed, in which the adjustment is more or less non-dissipative, a simpler embodiment is possible, wherein a flow-limiting valve is provided in the high-pressure line to the hydraulic transformer and/or in the connecting line to the hydromotor. Limitation of the flow is realized by throttling the oil flow so that energy is lost. Because of the simplicity of the embodiment and the considerable operational reliability, this solution may be applied as safeguard in addition to the above-mentioned more advanced control system.

An example of the above-described installation is a fork-lift truck comprising a hydraulic aggregate, where always enough energy must be available, for example, for lifting the load. In this deployment the power used because of the movable drive is, for example, limited to 90% of the aggregate's power, so that always sufficient energy remains available for the lift drive.

The control means 47 discussed above may also be used to control the hydraulic transformer 44 such that displacements at low speed are possible. The hydraulic transformer controls the movement of the hydromotor 48 by means of fluid pressure with the consequence that, due to the compressibility of the fluid in the hydraulic transformer and due to pressure fluctuations during rotation of the hydraulic transformer's rotor, the hydromotor does not immediately start when the adjustment mechanism 45 is being operated, so that extra provisions are required. Small movements of the hydromotor are possible if during actuation by the adjustment mechanism the face plate oscillates around the adjusted position with a deflection of preferably 10 degrees. The oscillation frequency depends on the hydraulic transformer, the hydromotor 48 and the connecting lines 51, and may be between 3 and 16 Hz or higher. In order to avoid loss of energy during adjustment of the face plate, the frequency chosen is preferably as low as possible. In practice, 7 Hertz has been proven to be a good oscillation frequency. The oscillation of the face plate around an adjusted position in the afore-described manner induces pressure oscillations of the same frequency in the connecting line, and it allows the hydromotor 48 to move at low speed over a relatively large distance, facilitating precise displacements. An additional advantage is that the face plate always moves inside the housing, so that there is always an oil film between the housing and the face plate, with the consequence that less energy is required for adjusting the face plate.

In addition to the above-described manner for oscillating the face plate by means of an actuator 46 controlled by a control system 47, the adjusting mechanism 45 may carry out a hydraulically driven oscillation around the adjusted value, so that said oscillation can also be applied, for example, in a manually controlled embodiment as described in FIG. 13.

Instead of the above-described oscillation of the face plate around the adjusted position it is possible to obtain the same effect if the hydraulic transformer is provided with a mechanism by which the top dead centre TDC oscillates around a position of equilibrium by means of, for example, allowing the bent housing 3 (see FIG. 1) to oscillate in relation to the housing 5. This distinguishes the oscillation from the adjustment of the face plate 10, making it more simple to adjustment the face plate.

The invention claimed is:

1. An apparatus for executing activities assisted by equipment driven by a hydraulic unit, comprising:

one of a rotating and a linear hydromotor being at least one of loadable and movable in two directions;

a hydraulic transformer provided with a rotor and having a continuously variable setting controlled by an adjustment means;

a connecting line connecting the one of the rotating and linear hydromotor and the hydraulic transformer, the apparatus comprising:

a pressure source for storing and delivering fluid of high pressure, a high-pressure line connecting the pressure source and the hydraulic transformer;

a tank for receiving and supplying fluid at low pressure;

a low pressure line connecting the tank and the hydraulic transformer; and a control means for controlling the one of the rotating and linear hydromotor by setting the adjustment means and thereby setting a fluid pressure in the connecting line, wherein the control means comprises a means for restricting a hydromotor load and a hydromotor speed by adjusting the adjustment means based on a feedback of the hydromotor load and the hydromotor speed using a sensor for measuring the flow rate of the fluid flow in the connecting line between the one of the rotating and linear hydromotor and the hydraulic transformer and one of a sensor for measuring the flow rate of the fluid flow in the high-pressure line to the hydraulic transformer and an algorithm for calculating the hydromotor load based on the setting of the adjustment means and a measured flow rate.

2. An apparatus according to claim 1, wherein the sensor is a flow sensor in the connecting line.

3. An apparatus according to claim 1, wherein the sensor is a revolution sensor for measuring a rate of rotation of the rotor.

4. An apparatus according to claim 1, wherein the sensor is a movement sensor for measuring a rate of movement of the one of the rotating and linear hydromotor.

5. An apparatus according to claim 1, wherein the sensor comprises a flow restriction valve disposed in one of the high-pressure line and the connecting line.

6. An apparatus according to claim 1, wherein the pressure source comprises:

an aggregate having a maximum power rating, and the control means includes a setting so that a power use of the one of the rotating and linear hydromotor is less than an adjustable value which is a portion of the maximum power rating.

7. An apparatus according to claim 1, wherein the hydraulic transformer is provided with means for causing the fluid pressure in the connecting line to oscillate around an adjustable value at a frequency of at least 3 Hertz.

8. An apparatus according to claim 1, wherein the adjustment means comprises a continuously adjustable setting that is designed to change the setting within 500 msec from a first extreme setting via the zero position to a second extreme setting.

9. An apparatus according to claim 1, wherein the adjustment means includes spring-activated elements for returning the hydraulic transformer into a neutral position wherein the fluid pressure in the connecting line is minimal.

10. An apparatus according to claim 1, wherein the one of the rotating and linear hydromotor is a linear cylinder and the connecting line is coupled to the low-pressure line via a non-return valve.

11. An apparatus according to claim 1, wherein the hydraulic unit is suitable for a pressure exceeding the pressure prevailing in the high-pressure line.

12. A hydraulic transformer for use in an apparatus according to claim 1, wherein a first fluid flow having a first pressure is transformed into a second fluid flow having a second pressure, comprising a housing, a first line connection, a second line connection and a third line connection, a rotor which in relation to the housing is limitlessly rotatable, a plurality of fluid chambers whose volume, when the rotor rotates at a first angle, varies between a minimum and a maximum volume, and a face plate provided with face plate conduits for, while the rotor is rotating, alternatingly connecting the fluid chambers with the three line connections, which face plate is rotatable around a rotation axis in relation to the housing and is provided with means for without interruption keeping a face plate conduit in communication with the respective line connection while the face plate is rotating, wherein the face plate, in relation to the housing, is able to rotate at a second angle wherein the second angle is approximately equal to the first angle.

13. A hydraulic transformer according to claim 12, wherein the face plate at the side of the fluid chambers is bordered by a first separating surface and at the side facing away from the fluid chambers by a second separating surface, the first separating surface comprising at least three rotor gates located at a first radius and being in communication with three face plate conduits, and the second separating surface comprising two housing gates located at a second radius, and each being in communication with a face plate conduit, wherein the third face plate conduit is in communication with a housing gate located at a third radius which is different from the second radius.

14. A hydraulic transformer according to claim 12, wherein the face plate at the side of the fluid chambers is bordered by a first separating surface and at the side facing away from the fluid chambers by a second separating surface, the first separating surface comprising at least three rotor gates located at a first radius and being in communication with three face plate conduits, and the second separating surface comprising two housing gates located at a second radius, each being in communication with a face plate conduit and the third face plate conduit being in communication with a housing gate at the external circumference of the face plate.

15. A hydraulic transformer according to claim 12, wherein the face plate at the side of the fluid chambers is bordered by a first separating surface and at the side facing away from the fluid chambers by a second separating surface, the first separating surface comprising at least three rotor gates located at a first radius and being in communication with three face plate conduits, and the second separating surface comprising two housing gates located at a second radius, and each being in communication with a face plate conduit, the third face plate conduit being in communication with a housing gate near the rotation axis of the face plate.

16. A hydraulic transformer according to claim 12, wherein the face plate at the side of the fluid chambers is bordered by a first separating surface and at the side facing away from the fluid chambers by a second separating surface, the first separating surface comprising at least three rotor gates located at first radius and being in communication with three face plate conduits, and the second separating surface comprising two housing gates located at a second radius, and each being in communication with a face plate conduit, at the second separating surface, the housing is provided with four face plate gates located at the second radius; two face plate gates being positioned diametrically opposite one another and being in direct communication with the first and the second line connection respectively, while the other two face plate gates positioned diametrically opposite one another are in communication via a shuttle valve with the first and a second line connection.

17. A hydraulic transformer according to claim 16 wherein the shuttle valve forms part of the face plate.

18. A hydraulic transformer according to claim 16 wherein the shuttle valve is coupled to the face plate.

19. A hydraulic transformer according to claim 12, wherein the rotor includes one of nine and twelve fluid chambers.

20. A hydraulic transformer according to claim 12, wherein rotor gates are separated by walls and face plate gates and the rotor gates are dimensioned such that at least two rotor gates are of the same size, and the walls between the rotor gates can close respective fluid chambers, simultaneously, for a particular position of the rotor.

21. A hydraulic transformer for use in an apparatus according to claim 1, wherein a first fluid flow having a first pressure is transformed into a second fluid flow having a second pressure, the hydraulic transformer comprising a housing, a first line connection, a second line connection and a third line connection, a rotor which in relation to the housing is limitlessly rotatable having a plurality of fluid chambers whose volume during rotation of the rotor varies between a minimum volume and a maximum volume, a plurality of rotor conduits for connecting a plurality of face plate gates with the fluid chambers, and a face plate provided with three rotor gates cooperating with the face plate gates which during rotation of the rotor serve for closing and alternatingly connecting the fluid chambers with the three line connections, wherein the maximum volume of the fluid chambers to be closed by means of the face plate is maximally five times as large as the minimum volume.

22. A hydraulic transformer according to claim 21, wherein the maximum volume of the fluid chambers to be closed by means of the face plate is maximally three times the minimum volume.

23. A hydraulic transformer according to claim 21, wherein the rotor includes one of nine and twelve fluid chambers.

24. A hydraulic transformer according to claim 21, wherein the rotor gates are separated by walls and the face plate gates and the rotor gates are dimensioned such that at least two rotor gates are of the same size, and the walls between the rotor gates can close respective fluid chambers, simultaneously, for a particular position of the rotor.

* * * * *